United States Patent [19]

Meyer et al.

[11] Patent Number: 4,778,276

[45] Date of Patent: Oct. 18, 1988

[54] DEVICE AND PROCESS FOR CONTINUOUS SUPPLY OF HYDRAULICALLY SETTING COMPOUND

[75] Inventors: Adolf Meyer; Helmut Steinegger; Wolfgang Schroeder, all of Leimen, Fed. Rep. of Germany

[73] Assignee: Heidelberger Zement Aktiengesellschaft, Heidelberg, Fed. Rep. of Germany

[21] Appl. No.: 896,815

[22] Filed: Aug. 15, 1986

[30] Foreign Application Priority Data

Sep. 13, 1985 [DE] Fed. Rep. of Germany ..... 3532722

[51] Int. Cl.[4] ..... B01F 7/08; B28C 7/06; B28C 5/14

[52] U.S. Cl. ..... 366/2; 366/28; 366/40; 366/64; 366/303; 366/319

[58] Field of Search ..... 366/20, 27, 28, 29, 366/35, 38, 40, 50, 52, 64, 67, 319, 303, 2, 81, 66

[56] References Cited

U.S. PATENT DOCUMENTS

| | | | |
|---|---|---|---|
| 141,947 | 8/1873 | Pierce | 366/303 X |
| 2,538,891 | 1/1951 | Zimmerman et al. | 366/319 X |
| 2,917,395 | 12/1959 | Csanyi | 366/40 X |
| 3,211,436 | 10/1965 | Butterfield | 366/67 |
| 3,469,824 | 9/1969 | Futty et al. | 366/64 |
| 3,885,774 | 5/1975 | Harris et al. | 366/20 |
| 4,061,316 | 12/1977 | Austin | 366/319 X |
| 4,175,867 | 11/1979 | Piazza | 366/9 |
| 4,205,919 | 6/1980 | Attwell | 366/34 |
| 4,223,996 | 9/1980 | Mathis et al. | 366/35 X |
| 4,334,788 | 6/1982 | Miner | 366/303 |
| 4,449,826 | 5/1984 | Mathis et al. | 366/28 X |
| 4,586,823 | 5/1986 | Schondorfer et al. | 366/64 X |

FOREIGN PATENT DOCUMENTS

| | | | |
|---|---|---|---|
| 2942325 | 4/1981 | Fed. Rep. of Germany | 366/67 |
| 3241193 | 5/1984 | Fed. Rep. of Germany | 366/52 |
| 1206115 | 1/1986 | U.S.S.R. | 366/38 |

*Primary Examiner*—Harvey C. Hornsby
*Assistant Examiner*—Scott J. Haugland
*Attorney, Agent, or Firm*—Kurt Kelman

[57] ABSTRACT

A device for continuously preparing a hydraulically setting mass comprises a tubular housing having a downstream outlet opening and an upstream supply station for a dry component material of the mass, the supply station including a storage bin for the dry material. A driven rotating shaft extends from the storage bin through the tubular housing towards the outlet opening, rotation of the shaft causing a feed flow in the direction of the outlet opening, and the rotating shaft is equipped with a dosing screw feeding the dry material out of the storage bin, a plurality of radially projecting mixing blades for mixing the material fed by the dosing screw, and an implement for finely granulating the mixed material downstream of the mixing blades, the granulating implement being comprised of at least two interdigitating comb-like elements, one of the comb-like elements being carried by the shaft for rotation therewith and another comb-like element being affixed to the tubular housing.

8 Claims, 3 Drawing Sheets

DEVICE AND PROCESS FOR CONTINUOUS SUPPLY OF HYDRAULICALLY SETTING COMPOUND

Figure 1:
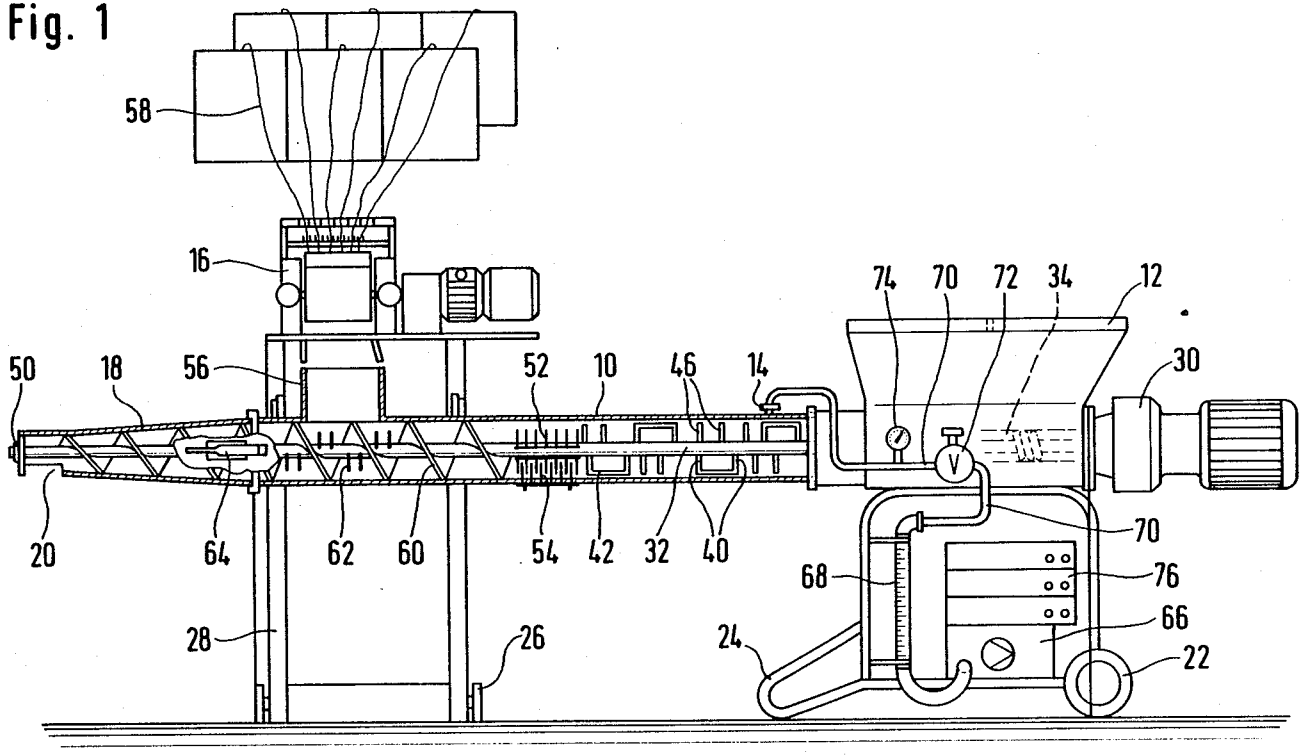

The invention is a device and a process for the continuous supply of hydraulically setting compound, especially wet mortar or dry mortar, preferably with a portion of fibers. A preferred area of application is the manufacturing of fiber concrete, especially fiberglass concrete, but also concrete containing steel fibers, plastic fibers, etc.

According to the state of the art, continuous manufacturing of fiber concrete is only done by means of an ejection or spray process. However, this entails a considerable loss of material, especially of the fibers which are needed in large volumes and which are corresponding cost-intensive. On the other hand, known mixing processes for manufacturing fiber concrete are done discontinuously. First of all, the hydraulically setting matrix is prepared: by means of additives, it has to be adjusted to an extremely soft consistency. Both the preparation of the matrix as well as the addition of the fibers calls for specially trained personnel. Furthermore, it is hardly possible to achieve a uniform consistency and the same proportion of fibers in successive batches of the fiber concrete.

The task of the invention is to furnish a simply designed, compact and easy-to-operate device as well as a process by means of which a hydraulically setting compound, especially wet mortar or dry mortar, can be continuously supplied in a consistency that is ideally suited for the addition of fibers, and which, in particular, allow for continuous manufacturing of fiber concrete with good material utilization and with a selectable uniform composition and consistency that can be reproduced repeatedly.

The invention makes it possible to manufacture fiber concrete by means of a continuous mixing process. Thus, by means of a continuous material flow, the invention produces fiber concrete having a uniform composition, but with a wide range of possible variations, without the high level of material losses associated with the ejection process. The type of fiber, the fiber length and volume can be varied over a wide range. The mixing process gently adds the fibers to the mortar and, because the material is supplied in a steady flow, preferably occurring only in the device according to the invention, there is no risk of damaging or destroying the fibers by mixing them for too long a time.

The device has a housing that has a charging opening and an outlet opening. The housing contains a driven rotating shaft which brings about a feed flow through the housing. In the direction of flow, the shaft is fitted with implements arranged one after the other for dosing, mixing, fine granulation and, if so desired, for the addition of fibers.

The structure of the device is simple and compact, and it is easy to make the necessary adjustments, so that even untrained personnel can do so. For example, the yield of the device can be regulated by changing the speed of the shaft. Of course, the device can also be run at a constant speed. A change in the yield can then be made, if so desired, by replacing the dosing shaft.

In a preferable design, the housing is essentially cylindrical and, if applicable, has tapered sections, and the shaft is positioned in the middle of and axially in the housing and preferably runs on double bearings. Thus, the result is an especially sturdy, compact structure. The housing can be divided up into sections that can preferably be joined together by means of a rapid-action closure. In this manner, the device can be taken apart into segments that are convenient and easy to transport and it can be quickly assembled and dismantled, a feature that makes it especially simple to clean.

The charging opening of the device can be provided with a supply bin, for example, in the form of a mountable hopper or silo connection. This means that it is possible to charge the device from sacks as well as from a silo with a minimum of conversion work. For removing material from the supply bin, there is preferably a dosing screw, which is located on a section of the shaft on the inside of the supply bin. Thus, precisely preselectable dry material dosage is achieved in a technically simple manner.

In the outlet opening of the supply bin, the housing can have a narrowing of its cross section, preferably through the middle, into which the shaft with the dosing screw projects. As a result of this narrowing of the cross section, at the outlet end of the supply bin there is an accumulation of material which facilitates maintaining a constant dosing rate. Moreover, the narrowing of the cross section completely separates a dry zone of the device, which includes the supply bin, from a wet zone that is downstream, if applicable. Thus, when the device is switched off and consequently the feed flow is interrupted, no water can penetrate into the supply bin. This is of great importance since under actual operating conditions, the need arises repeatedly to briefly interrupt production of the fiber concrete. Switch-off times of a certain length, e.g. 10 to 15 minutes, are possible with the device according to the invention without the need to take any special measures; subsequently the device starts up again promptly without any problem whatsoever.

Downstream from the dosing zone of the device according to the invention follows a mixing zone in which the shaft has essentially radially projecting mixing blades, at least some of which can be positioned at an angle to the direction of flow. At the same time, these mixing blades transport the material forwards. They can be fitted with scrapers which touch the inner wall of the tube and/or the end wall of the narrowing of the cross section and, in a preferred version, these scrapers extend in the axial direction and are attached to the tips of each pair of mixing blades. These scrapers have an intensifying effect on the mixing process, and they are responsible for extending the mixing zone directly up to the inner wall of the tube. The latter is constantly scraped clean, at the same time providing a bearing for the shaft. The functioning of scrapers on the narrowing of the cross section of the housing keeps this area free of wet material, thus prolonging the period of time during which the device can be switched off without any problem.

In the vicinity of the mixing zone, the housing can have a peripheral water connection whose spraying direction is preferably pointed at least slightly downstream. By adding water, the device according to the invention can mix mortar of the kind needed to manufacture fiber concrete. By supplying the water with a spray direction pointing downstream, water is kept away from the dosing zone and the supply bin so that, once again, the possible switch-off time of the device is prolonged. It must be emphasized, however, that the device according to the invention does not necessarily have to operate with water added to it; it can also serve to prepare a hydraulically setting dry compound preferably with a portion of fibers.

Downstream from the mixing zone follows a fine granulation zone, which, if desired, can also be left out. As a fine granulation implement, the shaft is fitted with at least one comb which meshes by means of the key-lock principle with at least one more comb that is rigidly mounted onto the housing. The combs can extend in an axial direction and have essentially radially positioned teeth. The use of a number of combs is recommended, preferably arranged at equal angle intervals and offset in the circumferential direction. By means of these combs, homogenization and a pasty consistency are achieved in the compound, the result is extremely free-flowing and practically lump-free and therefore perfectly suited for adding fibers. Addition of relatively costly additives is not absolutely necessary but, if so desired, this can, of course, be done, by addition together with the mixing water, for example.

Downstream from the fine granulation zone, there can be a fiber addition opening with a chute leading into the housing. In the vicinity of the chute, the shaft has a spiral axial screw and, if applicable, further fiber addition implements, for example, in the form of curved blades projecting radially from the shaft, preferably curved in the circumferential direction opposite to the rotational direction of the shaft. These blades uniformly and gently incorporate the fibers. Thus, even fragile fibers can be used, which would be destroyed by the preceding intensive treatment of the hydraulically setting compound. As a result of the work being done while there is a continuous material flow, the time the fibers spend in the feed area and among the fiber addition blades is restricted in a well-defined manner, so that any damage or destruction of the fibers by the adding process is effectively prevented.

The fibers can come from a fiber cutter which is located above the chute and which should be adjustable with respect to the fiber volume added and to the fiber length. By means of the operating parameters of such a fiber cutter, the composition of the compound thus produced can easily be regulated.

The housing of the device can be tapered downstream from the chute to the outlet opening and can contain a correspondingly tapered feed screw section located on the shaft. In this tapered end section of the housing, the fiber concrete is intensively and gently mixed in a final step.

The device according to the invention has a control unit which starts with an advance-running interval with respect to the fiber addition and stops with an after-running interval with respect to the fiber addition. Preferably one can choose between two selectable advance-running intervals for the shaft, the longer one is used for start-up after any dismantling of the device, and the shorter one is used for starting up again after a brief interruption in operation. In the latter case, there is still material in the housing and temporarily, only while the device is being started up, excess fiber addition to the mixture must be prevented. On the other hand, after a longer interruption, after dismantling and cleaning of the device, the housing is empty upon start-up and the flow time of the material from the supply bin to the fiber addition opening must be taken into account.

The composition of the material, even after the device has been switched off, remains the same and fiber material is saved, which normally is the most cost-intensive component.

The device according to the invention can be equipped with a safety circuit system which monitors the water pressure and/or suitable operating parameters of a fiber cutter and, in case of malfunction, switches off the device.

Figure 2:
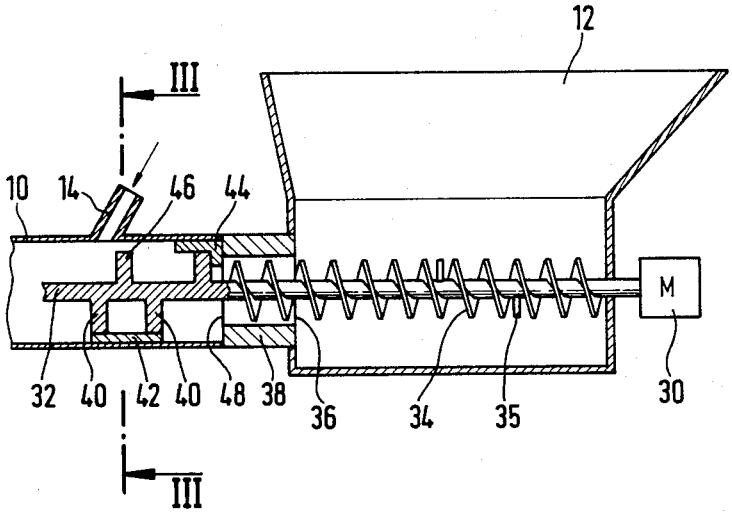
Figure 3:
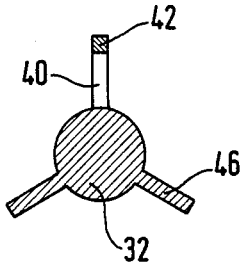
Figure 4:
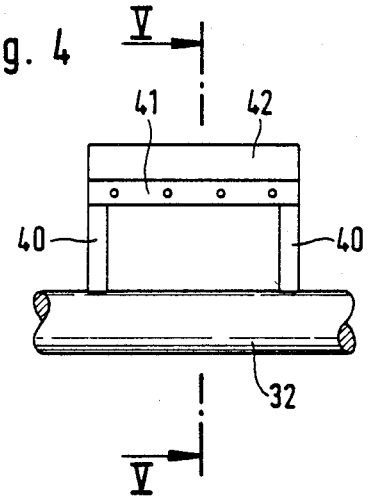
Figure 5:
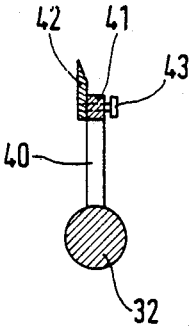
Figure 6:
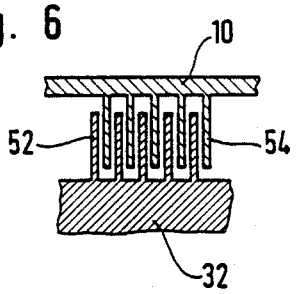
Figure 7:
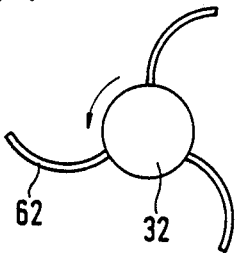

The invention is explained in greater detail with reference to an execution example illustrated in the drawings. Schematically the following is shown:

FIG. 1 a longitudinal section of the device according to the invention;

FIG. 2 the outlet area of a supply bin of the device, likewise a longitudinal section;

FIG. 3 a schematic cross section according to III—III of FIG. 2;

FIG. 4 a side view of a mixing implement of the device according to the invention;

FIG. 5 a section according to V—V of FIG. 4;

FIG. 6 a longitudinal section of a close-up of a fine granulation section of the device;

FIG. 7 fiber addition mechanism belonging to the device in a schematic axial top view onto a section of the shaft of the device.

The device shown in FIG. 1 has a housing with a horizontally positioned, essentially round cylindrical tube 10. At one end of the tube there is a supply bin 12 for dry material, downstream from that a radial water connection 14, further downstream a fiber addition station with a fiber cutter 16, and finally, at the other end, a tapered end section 18, which has an output opening 20 facing downwards. The device uses dry material, water and fibers in a continuous flow through the tube 10 to produce fiber concrete.

The device is mounted on rollers 22 in the vicinity of the supply bin 12 and braced against the floor by a stand 24. The fiber cutter 16 has a separate frame 28, also mounted on wheels 26. This structure allows for a quick and simple change of location.

On the execution example, the supply bin 12 is shown as a mountable hopper, which can be equipped, in particular, with a sack tearing mechanism. Nevertheless, instead of a mountable hopper, it is also possible to use a silo connection element, through which dry material is supplied directly to the device according to the invention. Conversion from one of the two variations to the other is simple.

The supply bin 12 has a motor 30 built onto it in the axial extension of the tube 10. This motor drives a shaft 32, which passes through the supply bin 12 and, positioned in the middle and axially, passes through the tube 10 along its full length. The shaft 32 is fitted with a number of implements which serve to dose the dry material from the supply bin 12, to mix, to finely granulate, to incorporate fibers and, not least, to transport the material through the tube 10.

FIG. 2 shows schematically how the dry material is moved out of the supply bin 12. A section of the shaft 32 which runs through the inside of the supply bin 12 has a dosing screw 34 as well as single, radially projecting loosening blades 35. The shaft 32 passes through a frontal outlet opening 36 of the supply bin 12, and this is the transition to the tube 10. The outlet opening 36 has a round cross section and it has a smaller diameter than tube 10, with respect to which it is positioned in the middle. The narrowing of the cross section is formed by a fairly long cylinder line 38 protruding radially to the inside and positioned coaxially to the tube 10. The dosing screw 34 projects into the cylinder liner 38 and ends there.

When the shaft 32 is rotating, the dosing screw d34 transports dry material at a well-defined rate of speed out of the supply bin 12 and into the tube 10. The dosing rate depends on the design geometry, especially on the size of the outlet opening 36 and the pitch of the dosing screw 34, on the chamber volume as well as on the speed of the shaft 32, which can be used to regulate the dosing rate over a wide range.

With reference to FIGS. 1 through 5, downstream from the dosing zone in the tube 10 follows a mixing zone. Here the shaft 32 has radially protruding mixing blades 40 which mix the material that is present in the tube 10 and, due to their shape—a suitable angle, etc.—they also transport it at the same time. Some of the mixing blades are fitted with scrapers 42, 44, which are made of hard rubber or the like and which touch the inner wall of the tube 10. In particular in FIGS. 4 and 5 one can see scrapers 42 which are attached at the radially extreme end of each pair of mixing blades 40 and which extend essentially in an axial direction. The mixing blades have a flat element 41, which serves as a holder to which the scrapers 42 are attached with screws or rivets 43. There are a number of such mixing blade groups 40 with scrapers 42, which are lined up at intervals in the axial direction of the shaft 32 (FIG. 1). The mixing blades 40 of the individual groups are offset at 120° angles in the circumferential direction. At the level of each group there are also single mixing blades 46 without scrapers, they are also offset at an angle of, for example, 120°. This geometry is shown schematically in FIG. 3.

As can be seen in FIG. 2, one of the scrapers 44 is located at the axial end of cylinder liner 38, on which the passage cross section for the material widens to the inner width of the tube 10. The scraper 44 touches both the end wall 48 of the cylinder liner 38 as well as the inner wall of the tube 10. Thus it ensures that the step-like transition to the outlet of the supply bin 12 is always scraped free of material, which, among other things, creates a well-defined separation between the wet zone and the dry zone of the device according to the invention.

Referring to FIGS. 1 and 2, the water connection 14 is in the vicinity of the mixing zone, specifically in its downstream section. The water connection 14, however, is at a certain distance from the diameter gradation at the end of cylinder liner 38. Moreover, it is at an incline with respect to the tube axis, so that the direction of the water spray is downstream in the direction of the material flow. As a result of all of these measures, especially the diameter gradations within the housing and the scraper 44 installed there, water is prevented from penetrating into the supply bin 12. In particular, this barrier is effective even when the drive of the shaft switches off, thereby interrupting the feed flow of the material. Thus it is possible to interrupt the continuous mortar production briefly, for example, for 10 to 15 minutes, and then to start up the device again without having to perform any special measures.

The scrapers 42, 44 intensify the mixing process, and they ensure that the mixing zone extends across the entire cross section of the tube 10. Furthermore, they also serve as a bearing for the shaft 32. As FIG. 1 shows, the shaft 32 runs on double bearings; as the second bearing, there is a roller bearing 50 at the end of the tapered end section of the tube 18.

Downstream from the mixing zone follows a fine granulation zone of the device. In this section the shaft 32 has comb-like implements 52, which are adjacent to the shaft 32 with their comb spines, and these combs extend essentially in a radial direction and have radially protruding teeth. At the same axial level, there can be several combs 52 offset at angles, for example, three combs 52 with an angle interval of 120°. The combs 52, which rotate with the shaft 32, mesh with the combs 54 that are rigidly mounted onto the housing. The latter have their spines up against the inner wall of the tube 10, essentially extend in an axial direction and have teeth positioned radially towards the inside. The meshing of the combs 52, 54, which is according to the key-lock principle, is illustrated in FIG. 6. When the shaft 32 rotates, the material being transported through tube 10 is finely granulated and homogenized between the combs 52, 54. In this manner it is free of lumps, has a pasty and very free-flowing consistency and is thus very optimally prepared for the addition of fibers. The combs 52, 54 are preferably made up of steel wire. However, it is also possible to use other materials, especially plastic and hard rubber.

Downstream from the fine granulation zone follows the fiber addition opening with the fiber cutter 16. Fiber strands 58, for example fiberglass rovings, are fed into the fiber cutter and cut into preselected lengths. The volume of fiber supplied per time unit can be regulated by means of the draw-in speed of the fiber cutter 16. After the cutting step, the fibers enter a chute 56, which is essentially positioned vertically and leads into the tube 10 of the device.

The invention is not restricted to the use of glass fibers, especially alkali-proof glass fibers. For example, other mineral fibers, plastic fibers, steel fibers, among others, can be processed.

Downstream from the combs 52, 54, the material transported through the device enters a spiral axial screw 60, which extends below the chute 56 and through the tapered end section 18 all the way to the outlet opening 20. The screw 60 is on the shaft 32 and mixes the material together with the fibers. At the level of the chute 56, the shaft 32 is additionally fitted with blade-shaped fiber addition implements 62. As FIG 1 shows, these blades or pins 62 are lined up axially at intervals. Furthermore, they are distributed along the circumference of the shaft 32, whereby at the same axial level, for example, three blades 62 can be positioned at offset angles. This is illustrated in FIG. 7; for the sake of clarity, the screw 60 has not been depicted. The blades 62 protrude essentially radially from the shaft 32, and they are curved in the circumferential direction, opposite to the direction of rotation of the shaft 32. With these blades 62, the fibers are added gently and uniformly to the material. Downstream from the chute 56 follows the tapered end section 18 which tapers down towards the output opening 20. The section of the screw 60 contained in this end section 18 is tapered correspondingly. Thanks to this shape, the addition of the fibers is gentle and especially intensive.

The device according to the invention is segmented. The tapered end section 18 is a removable piece which is attached to the tube 10 by means of a rapid-action closure 64. The tube 10, in turn, is affixed with an appropriate rapid-action closure, which is not described in further detail, to the supply bin 12. Consequently, one can easily dismantle the housing of the device for cleaning purposes. The shaft 32 consists of one piece, at least from the mixing zone to the outlet opening 20. The shaft section inside the supply bin 12 can be a separate part with which the shaft 32 can be attached by means of a detachable torsion-proof connection.

The device according to the invention can be used with or without the addition of mixing water to manufacture fiber-reinforced hydraulically setting compounds as well as for other purposes. A first design variation of the device includes the section extending from the supply bin 12 to just beyond the fine granulation implements 52, 54. This aggregate is only responsible for the continuous dosing, mixing and fine granulation of either dry material or a matrix mixed with water. In a second design variation the fiber addition section is also included. The combined aggregate can also be used either for mixing dry material with fibers or for adding fibers to a matrix mixed with water. A preferred area of application is the manufacturing of fiber concrete in a continuous mixing process.

The addition of water is preferably done by means of a water pump 66 via a dosing unit 68. From here the water flows via a pipeline 70, which contains a tap 72 and a pressure gauge 74, to the water connection 14.

The device according to the invention has a control unit 76 with a time-delay circuit which becomes effective when the device is started up and switched off. When the device is put into operation, the dosing and mixing shaft 32 starts up with an advance-running interval with respect to the fiber cutter 16. There are two different advance-running intervals which can be selected by push-button. A longer advance-running interval of, for example, 8 seconds, is used for the initial start-up of the device, after dismantling and cleaning, etc, i.e. in an operating state where the tube 10 is empty. This takes into account the fact that a certain running time is necessary after the dosing of the material from the supply bin 12 until it reaches the fiber addition opening. On the other hand, after the device has been switched off just briefly, a step that causes no problems thanks to the separation of the dry zone and the wet zone, the shorter advance-running interval of the dosing and mixing shaft 32 with respect to the fiber cutter 16 is selected, which can be, for example, one second. When the device is switched off, the fiber cutter is stopped first, while the shaft 32 runs a bit longer, for example, likewise about one second.

When a mixture is made using water, the water supply starts at the same time as the dosing and mixing shaft 32 does. There is a safety circuit that monitors the water pressure and prevents the device from running with insufficient water pressure. Furthermore, the fiber cutter 16 is monitored to make sure that no uncut fibers are drawn in, thereby giving rise to malfunctions. The fiber cutter 16 has a roller which is pneumatically controlled and which presses the fiber strands against rotating cutting knives. If the pneumatic operating pressure is too low, the device is switched off.

A central idea of the invention is to carry out various functions sequentially by means of a shaft and a drive, especially 1. dosing the dry material (transporting a given volume per time unit by means of the dosing screw), 2. dosing water and manufacturing the wet mixture in dosed volumes (given volume per time unit) by means of a continuous flow mixer;

3. adding or mixing in or incorporating fiber cuttings that are added in the fiber addition zone by a cutter in dosed amounts.

The device according to the invention allows for the continuous manufacturing of fiber concrete with a preselectable proportion of fibers and a given fiber length in a mixing process which supplies a constant material flow with a uniform and excellently reproducible composition. The material can be placed directly in molds, formwork, etc., for example, to make highly stable, thin-walled formed units. Further areas of application are the manufacturing of cement-bound pipe sheathing, fiber plaster, floor coverings, and many others. A wide variety of possibilities can be found in building renovation.

What is claimed is:

1. A device for continuously preparing a hydraulically setting mass, which comprises (a) a substantially cylindrical tubular housing having a downstream outlet opening, (b) an upstream supply station for a dry component material of the mass, the supply station including (1) a storage bin for the dry material, and (c) a driven rotating shaft extending from the storage bin through the tubular housing towards the outlet opening, rotation of the shaft causing a feed flow in the direction of the outlet opening, the rotating shaft being equipped with (1) a dosing screw feeding the dry material out of the storage bin, (2) a plurality of substantially radially projecting mixing blades for mixing the material fed by the dosing screw, and (3) an implement for finely granulating the mixed material downstream of the mixing blades, the granulating implement being comprised of at least two interdigitating comb-like elements, one of the comb-like elements being carried by the shaft for rotation therewith and another comb-like element being affixed to the tubular housing, and (d) a fiber supply station arranged downstream of the granulating implement, the shaft being further equipped at the fiber supply station with (4) a screw and (5) an implement for incorporating fiber supplied from the supply station in the finely granulated mixed material, the fiber incorporating implement being comprised of a plurality of curved blades substantially radially projecting from the shaft, the blades being curved in a circumferential direction in a direction opposite to the direction of rotation of the shaft.

2. The device of claim 1, wherein the comb-like elements extend in an axial direction and have substantially radially projecting teeth.

3. The device of claim 1, wherein the granulating implement comprises a plurality of said comb-like elements offset from each other in a circumferential direction by equal angular intervals.

4. The device of claim 1, further comprising a water inlet for supplying water to the dry material, and a pump for dosing the supplied water.

5. The device of claim 1, further comprising a water connection affixed to the periphery of the tubular housing in the range of the mixing blades, the water connection being at least slightly inclined downstream for delivering water to the mixed material in a downstream direction.

6. The device of claim 1, wherein the fiber supply station comprises a cutter for cutting the fibers of the fiber supply, the cutter being adjustable for controlling the quantity of the supplied fiber and the length of the fibers cut thereby, and a chute receiving the cut fibers from the cutter and supplying the cut fibers by gravity.

7. A method of operating and controlling the device of claim 1, comprising the steps of (a) starting rotation of the shaft before fiber is supplied and (b) stopping rotation of the shaft after the fiber supply has been completed.

8. The method of claim 7, comprising the further steps of selecting two periods for starting the shaft rotation, a first longer starting period initiating the operation of the device and a second shorter period commencing after a brief interruption.

* * * * *